US005924377A

United States Patent [19]

Rausch et al.

[11] Patent Number: 5,924,377

[45] Date of Patent: Jul. 20, 1999

[54] MODULAR ENCLOSURE SYSTEM SUITABLE FOR SHIPBOARD USE

[75] Inventors: Gregory P. Rausch, Lake Forest; Ronald S. Gold, Fullerton, both of Calif.

[73] Assignee: Raytheon Company, Lexington, Mass.

[21] Appl. No.: 08/882,807

[22] Filed: Jun. 26, 1997

[51] Int. Cl.[6] ..... B63B 3/02

[52] U.S. Cl. ..... 114/77 R; 114/71

[58] Field of Search ..... 114/71, 77 A, 114/77 R, 78, 343, 364, 65 R; 52/79.8, 79.9, 79.12

[56] References Cited

U.S. PATENT DOCUMENTS

| | | | |
|---|---|---|---|
| 738,400 | 9/1903 | Booker | 114/77 R |
| 1,149,598 | 8/1915 | Ross | 114/77 A |
| 3,371,639 | 3/1968 | Schillreff | 114/77 A |
| 4,732,103 | 3/1988 | Culbertson | 114/71 |
| 4,983,190 | 1/1991 | Verrando et al. | 55/21 |
| 5,784,836 | 7/1998 | Ehrick | 52/79.8 |

FOREIGN PATENT DOCUMENTS

| | | | |
|---|---|---|---|
| 0058588 | 4/1982 | Japan | 114/71 |
| 0200083 | 9/1986 | Japan | 114/71 |

*Primary Examiner*—Ed L. Swinehart
*Attorney, Agent, or Firm*—Colin M. Raufer; Leonard A. Alkov; Glenn H. Lenzen, Jr.

[57] ABSTRACT

A modular enclosure system particularly suited for use aboard a ship comprises a modular enclosure which is easily installed into and removed from an exoskeletal frame that is shock-mounted to a fixed surface, such as the deck of a ship. An enclosure is installed by placing it within a respective frame via complementary guide rails. A securing mechanism locks the enclosure into place within the frame, and an ejection mechanism enables an enclosure to be easily removed for purposes of maintenance, repair or reconfiguration, or in the event of an emergency. The enclosures are preferably water-tight and float if ejected into the sea. Rubberized boots surrounding all points of entry enhance the survivability of the enclosures in a nuclear/biological/chemical (NBC) environment. Shock-mounting the frames to the deck eliminates the need to shock-mount individual pieces of equipment and enables the use of cheaper and more readily available commercial off-the-shelf equipment. A number of frames and enclosures can be placed side by side on the deck of a ship to form a superstructure. By bolting outer panels over the exposed ends of the enclosures, double-walled protection is provided against shrapnel and munitions.

26 Claims, 5 Drawing Sheets

FIG. 3a.
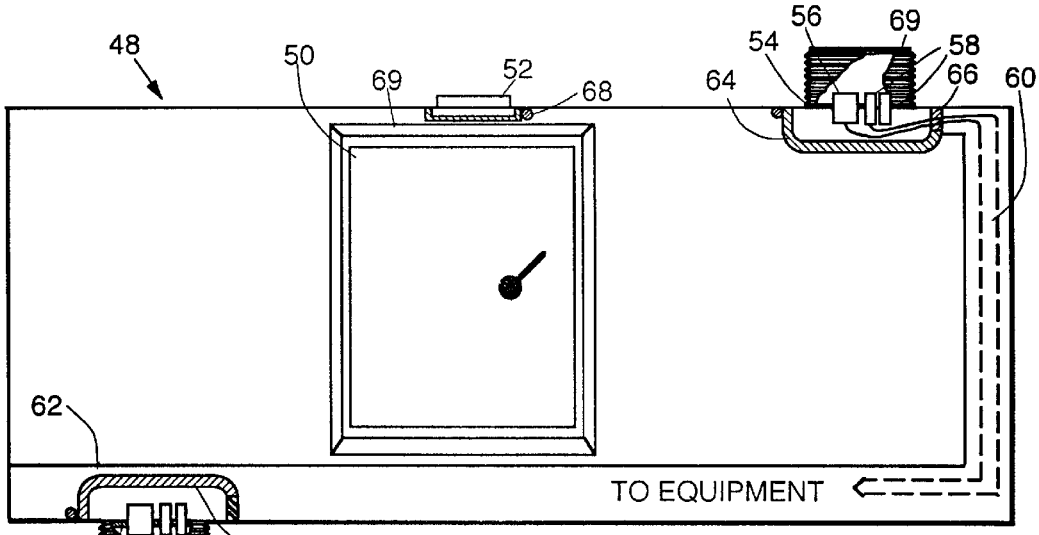
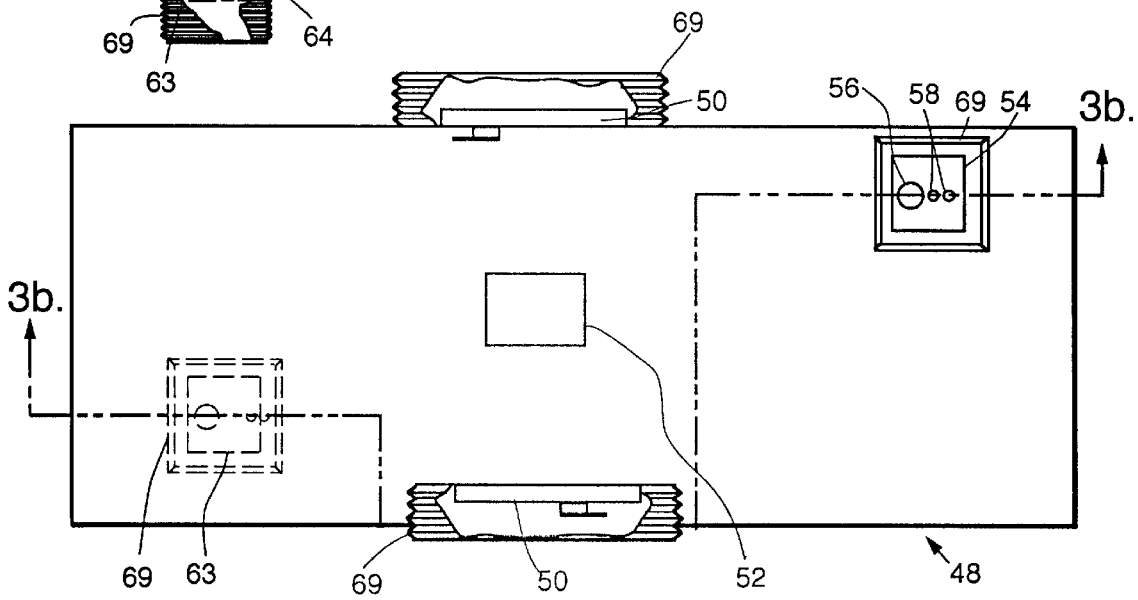
FIG. 3b.
FIG. 3c.
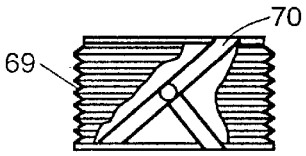

MODULAR ENCLOSURE SYSTEM SUITABLE FOR SHIPBOARD USE

BACKGROUND OF THE INVENTION

1. Field of the Invention

This invention relates to enclosures for equipment and personnel, particularly modular, self-contained enclosures suitable for use on a ship.

2. Description of the Related Art

The superstructure of a ship, i.e., the structure located above the ship's deck, typically includes a number of enclosed spaces which serve specific functions. On a military vessel, separate compartments might be dedicated to sonar, fire control, and command and decision functions, for example. Such spaces can include a significant amount of electronic equipment and may be continuously manned.

Historically, such spaces, referred to herein as "combat centers", are formed as an integral part of the ship's structure. Equipment is fastened to the metal walls and flooring of a dedicated compartment which is hard-mounted to the deck and other structural members. This arrangement has a number of drawbacks. For example, being hard-mounted to the ship's structure exposes the combat centers and their respective equipment to any impact shocks to the ship. This is typically accommodated by requiring that each piece of equipment and/or equipment console be independently shock-mounted, adding considerable cost to the equipment and preventing the use of commercial off-the-shelf (COTS) equipment which is generally not ruggedized to military standards. To install a large piece of equipment or to reconfigure a combat center typically requires that one or more wall sections be cut out and subsequently rewelded. Installation of new equipment typically requires a very inefficient and redundant procedure to be followed, in which the equipment is first set up and fully tested at a manufacturer's facility onshore, broken down and transported to the ship, then installed, set up, and fully tested again aboard ship. Furthermore, when equipment is hard-mounted to the structure of the ship, the entire ship must be taken in for repairs when a portion of the superstructure is damaged in battle, even if only one or two functions are affected.

SUMMARY OF THE INVENTION

A modular enclosure system is presented which is particularly suited for use aboard a ship and which solves the problems noted above. A modular enclosure is formed which is easily installed into and removed from an exoskeletal frame that is shock-mounted to a fixed surface such as the deck of a ship. The external surface of the enclosure and its respective exoskeletal frame are equipped with one or more complementary mounting guide rails. An enclosure is installed by placing it within its frame via the complementary guide rails. A securing mechanism locks the enclosure into place when it is in an appropriate position within the frame.

An ejection mechanism is preferably included to enable an enclosure to be easily removed from its secured position within a frame. One such mechanism is implemented by providing gear teeth on the frame's guide rail. The teeth of a corresponding sprocket wheel mounted to the enclosure are engaged with the frame rail's teeth so that when rotated, the sprocket wheel drives the enclosure from the frame. When an enclosure requires maintenance, repair or reconfiguration, it may be simply ejected from its frame and taken to a controlled environment. In the event of an emergency, an enclosure, its equipment, and its personnel can be ejected from the ship and out of harm's way.

A self-contained modular enclosure per the present invention is preferably capable of being made water-tight, so that if ejected from its frame while at sea it will float. Utility panels accessible from both outside and inside the enclosure are mounted in one or more of the enclosure's walls to provide electrical and plumbing services to the enclosure's interior, and water-tight hatches provide ingress and egress for personnel. Rubberized boots surrounding all points of entry and sealable against other boots or interior surfaces of the ship enhance the survivability of the enclosures in a nuclear/biological/chemical (NBC) environment.

The enclosures are preferably installed into respective exoskeletal frames, i.e., open metal structures into which the enclosures slide, which support the enclosures and to they can be secured. The frames are shock-mounted to the ship's deck, which eliminates the need to shock-mount individual pieces of equipment and/or equipment consoles and thus permits the use of non-shock-mounted COTS equipment which is typically cheaper and more readily available than its ruggedized military counterparts.

Because the enclosures can be easily installed and removed, equipment repair and reconfiguration can be accomplished considerably quicker than for previous hard-mounted combat centers. A number of frames and enclosures can be placed side by side on the deck of a ship to form a superstructure. By bolting outer panels over the exposed ends of the enclosures, double-walled protection is provided against shrapnel and munitions.

Further features and advantages of the invention will be apparent to those skilled in the art from the following detailed description, taken together with the accompanying drawings.

BRIEF DESCRIPTION OF THE DRAWINGS

FIG. 3*a* is a plan view of an enclosure per the present invention, illustrating several of its exterior features.

FIG. 3*b* is a sectional view taken along the section line 3*b*—3*b* of FIG. 3*a*.

FIG. 3*c* is a cut-away elevation view of a rubberized boot per the present invention, illustrating a mechanical arm for extending the boot.

DETAILED DESCRIPTION OF THE INVENTION

Figure 1:
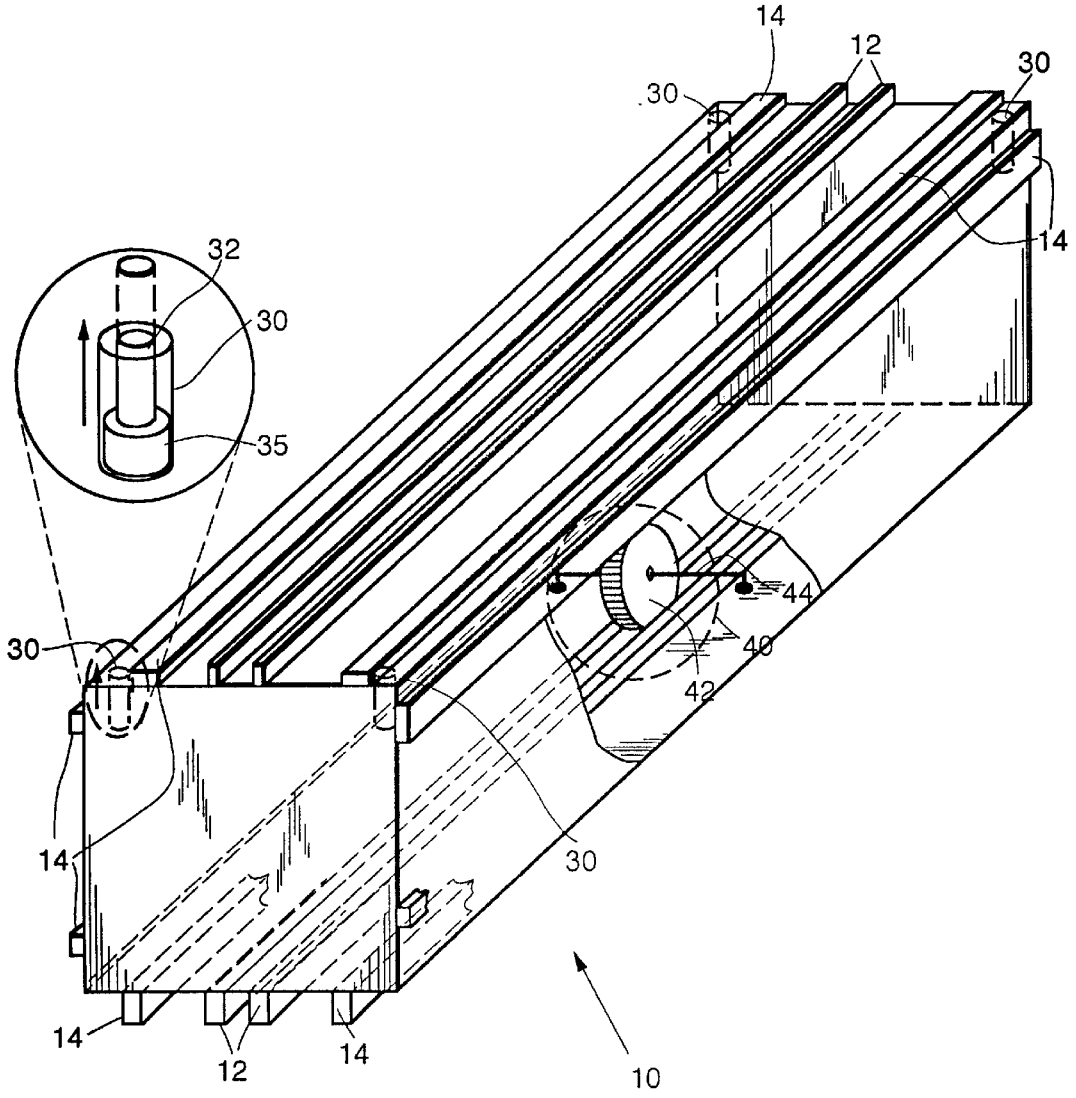
FIG. 1 is a perspective view of an enclosure per the present invention.

The exterior of a modular enclosure per the present invention is shown in FIG. 1. The enclosure 10 is not limited to any particular shape, but typically takes the approximate shape of a rectangular parallelepiped with two opposing long sides and two opposing short sides. At least one mounting guide member 12, preferably a guide rail, is attached to the exterior of the enclosure. Rub rails 14 are preferably attached to the long sides of the enclosure to help guide and protect the enclosure as it is being installed into a frame (discussed below).

The mounting guide rails 12 are not limited to any particular shape. A rail having a shape which will keep the enclosure centered as it is slid along a complementary guide rail, such as a U-shaped (shown) or "clam-shaped" rail, will suffice. The number of guide rails 12 required for a particular enclosure is a design choice that depends, for example, on the structure of the frame in which it is installed and the weight of the enclosure. A key benefit provided by the invention is the ease with which the modular enclosures can be installed and removed; at least one mounting guide rail is required to realize this advantage.

Figure 2:
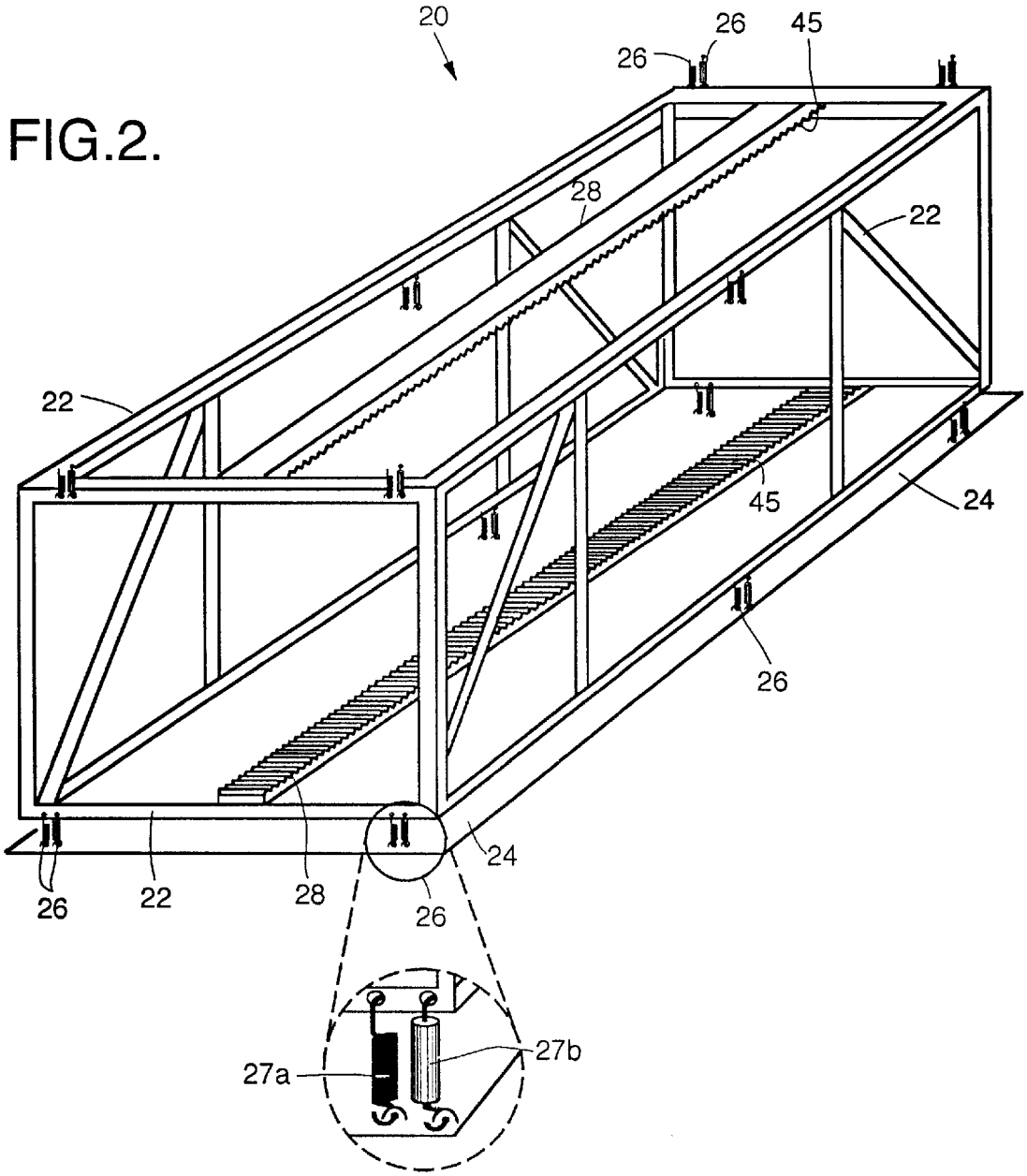
FIG. 2 is a perspective view of a frame for supporting the enclosure of FIG. 1.

A frame suitable for supporting and securing an enclosure per the present invention is shown in FIG. 2. The frame 20 preferably includes a number of support members 22 arranged to form an exoskeletal frame similar in shape to, but larger than, the enclosure it will be supporting. The frame is attached to the deck 24 of the ship and to other available support structures on the sides and above the frame, using shock-absorbing devices 26 such as coil springs 27*a* and hydraulically-actuated pistons 27*b*. The number of shock-absorbing devices used is a design choice which depends on the weight of the enclosure being supported and the steadiness with which the enclosure must be held, for example; at least six devices are recommended between the bottom of a rectangular frame and the deck of the ship: one at each corner and one halfway along the span of each of the longer frame members. If other support structures are available alongside and above the frame, the frame should also be secured to these, using additional shock-absorbing devices as appropriate.

Figure 2A:
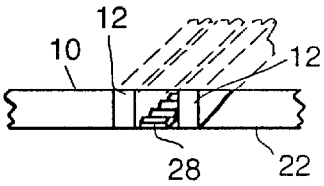
FIG. 2*a* is a fragmentary perspective view showing the fitting together of complementary guide rails mounted on an enclosure and frame per the present invention.

The frame 20 also includes at least one mounting guide rail 28 which is complementary to a mounting guide rail 12 affixed to an enclosure, i.e, the respective guide rails are arranged to fit together so that an enclosure can be guided into the frame via the guide rails. Complementary guide rails 12 and 28 are shown fitted together in FIG. 2*a*.

To accommodate a number of enclosures which are to be positioned side by side, an equal number of individual frames of the type shown in FIG. 2 are similarly positioned and attached to the deck. Alternately, a single exoskeletal frame can be arranged to support more than one enclosure, by either adding structural connecting members between adjacent individual frames or by making one large frame, with guide rails properly spaced for placing enclosures side-by-side within it, and dispensing with intervening vertical support members. This approach is not recommended, however, as the weight of the enclosures contained within the frame is likely to require vertical support members between each enclosure to provide sufficient support.

Referring back to FIG. 1, each enclosure 10 preferably includes a securing mechanism 30 for locking the enclosure into a fixed position once installed in a frame. One possible securing mechanism 30 consists of heavy-duty extendible and retractable pins 32 which are placed into recessed pockets 34 located in the enclosure's corners. The pins 32 are retracted below the surface of the enclosure 10 while it is being installed into a frame 20, and are extended so that they extend above the surface of the enclosure when it has reached a suitable position within the frame. The pins 32 and frame are arranged such that when extended, any significant movement of the enclosure 10 causes one or more pins to contact the frame, which prevents further motion. The pins 32 are extended by means of respective electrically-operated actuators 35, for example, which can also retract the pins to "deactivate" the securing mechanism 30.

There are numerous variants of the above-described securing mechanism which would be suitable. For example, extendible pins could be mounted to the frame 20 and arranged to extend into recesses in the enclosure 10 in order to secure it. The exact nature of the securing mechanism, such as the number and strength of the securing pins, is determined by the application, considering such factors as the weight of the enclosure to be secured and how much movement within the frame can be tolerated while secured.

An ejection mechanism is preferably included to enable the enclosures to be quickly removed from their respective frames, whether for purposes of repair, replacement or reconfiguration, or in an emergency situation to get an enclosure and its contents away from the ship. One possible ejection mechanism 40 is shown in FIG. 1. A sprocket wheel 42 is preferably mounted such that the bottom of the wheel protrudes between adjacent mounting guide rail 12, and the top of the wheel protrudes into a wheel well in the floor of the enclosure. The wheel's axle 44 is firmly attached to the enclosure 10. The frame's complementary guide rail 28 is "toothed", as indicated by reference number 45 in FIG. 2, and sprocket wheel 42 has gear teeth sized to mesh with the rail's teeth. To remove an enclosure 10 from its frame 20, sprocket wheel 42 is made to rotate, such as with an electrical or a hydraulic motor, to drive the enclosure 10 out of the frame 20. Prior to ejection, the securing mechanism 30 must be deactivated; the ejection mechanism 40 is preferably arranged to automatically deactivate the securing mechanism prior to ejection, such as by sending an electrical signal to actuators 35 to retract pins 32, to shorten the time required to effectuate an emergency ejection. Alternatively, the securing mechanism may be retracted as an independent step, prior to activating the ejection mechanism.

As stated above, the described ejection mechanism 40 described is but one possible means of ejecting a modular enclosure. Alternative mechanisms, such as a hydraulic ram or pneumatic piston, could also be used to force an enclosure out of its frame via its guide rails.

The guide rails 12 and 28 are preferably lubricated, with a "TEFLON" spray, for example, or by using baked-on "TEFLON" surfaces, to make the installation and removal of an enclosure 10 easier. The external walls of an enclosure intended for military use are preferably made from high energy impact composites, preferably with a "KEVLAR" coating, or by implementation of reactive armour, to enhance survivability, especially in the event of a missile hit; the supporting frame 20 is preferably aluminum. In a non-hostile environment, the enclosure 10 and frame 20 are both preferably made from aluminum.

An enclosure 10, together with its respective frame 20 capable of being shock-mounted to a fixed surface, and including an ejection mechanism 40 to aid in the removal of the enclosure from the frame, forms a modular enclosure system. Such a system is particularly well-suited for use on ships, where it is frequently necessary to remove and replace large installations of electronic and mechanical equipment. Aboard military vessels several enclosures may be employed as combat centers, each containing an array of equipment intended to perform a specific function. The modular enclosure system presented is not limited to shipboard use, however. Other applications include aircraft, on large ground vehicles, or even a stationary enclosure which requires a high degree of shock isolation.

A top plan view and a corresponding sectional view of a modular enclosure 48 per the present invention are shown in FIGS. 3*a* and 3*b*, respectively. The enclosure preferably includes at least one main hatch 50 to provide equipment and personnel access to the enclosure's interior. A ventilation fitting 52 is preferably provided to which ducting can be connected. At least one utility panel 54 is preferably provided which includes bulkhead-type connectors 56 and fittings 58 for providing electrical and plumbing services, respectively, to the interior of the enclosure. Ducting 60 is preferably provided to route cabling and plumbing lines down the side of the enclosure and under a false floor 62, from where they are further distributed. A second, redundant utility panel 63 is preferably provided on an opposite surface to enhance survivability.

To further enhance the survivability of the personnel and equipment housed within the modular enclosures, all points of entry into the enclosure are preferably capable of being made water-tight. Thus, the main hatch 50 is preferably water-tight when closed, or can quickly be made so. Respective water-tight access hatches 64 are preferably provided which can be closed over utility panels 54 and 63; cables and plumbing lines preferably are run through a water-tight seal 66 en route to ducting 60. Similarly, a water-tight hatch 68 is preferably provided which seals off the ventilation opening 52 when closed.

Figure 5:
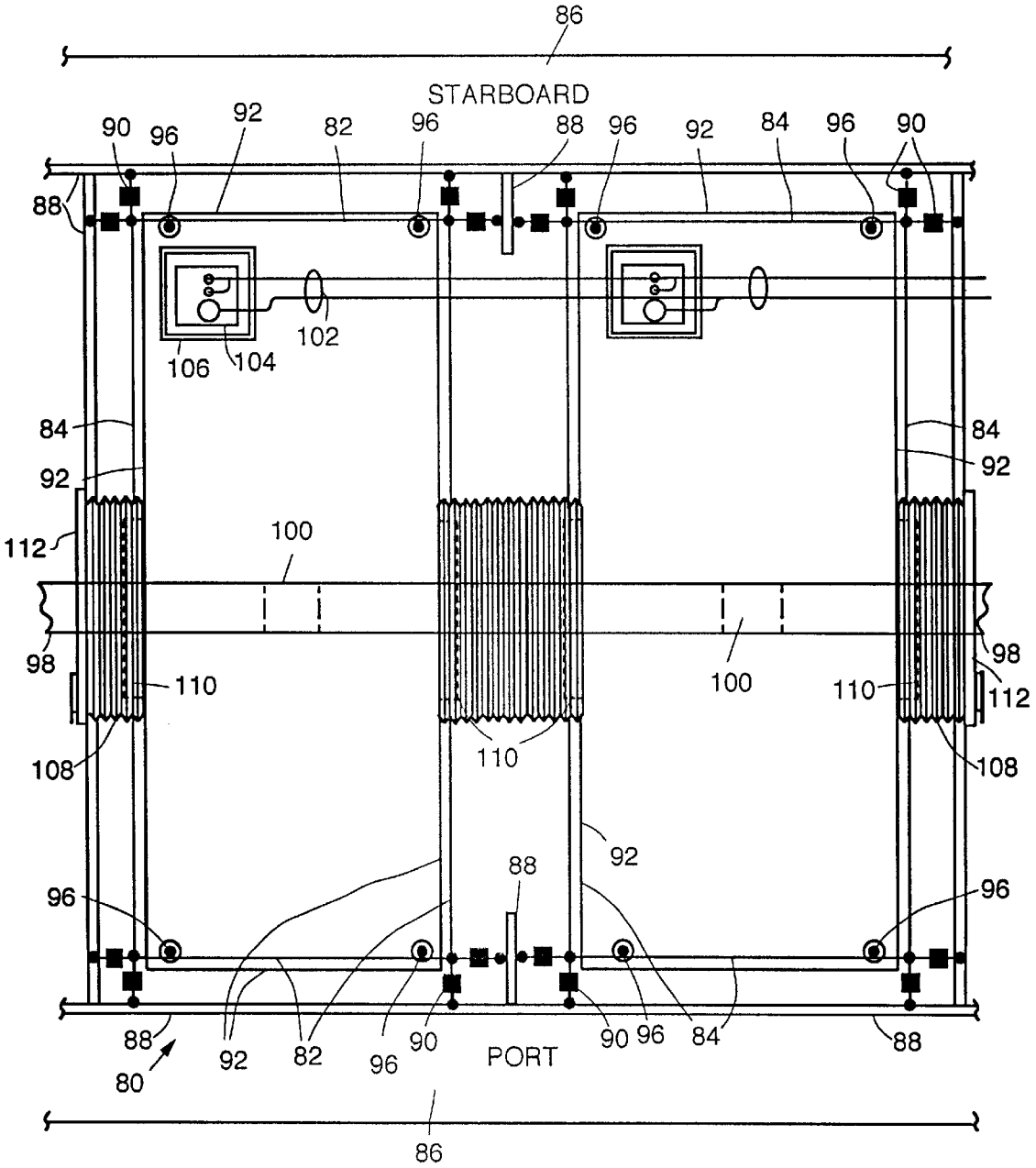
FIG. 5 is a plan view of two enclosures per the present invention, arranged to form part of the superstructure of a ship.

For protection in an nuclear/biological/chemical (NBC) environment, rubberized boots 69 (shown cut-away over main hatch 50) are preferably provided around the outer perimeters of points of entry. The boots 69 preferably include a mechanical or hydraulic arm arrangement for extending the boot and locking it in an extended position. In the cut-away elevation view of a boot 69 shown in FIG. 3*c*, a mechanical arm 70 is attached to the top and bottom of a boot; as arm 70 is slid into a locked position, boot 69 extends and is locked in its extended position. When extended, the extended end of the boot contacts and seals against interior surfaces of the ship, or contacts a corresponding boot on an adjacent enclosure (as shown in FIG. 5). A magnetic strip may be installed around the periphery of the boot to help it to seal against a metallic interior surface or to a corresponding strip on another boot. With the water-tight hatches closed and sealed, an enclosure ejected from its frame into the water would float. In an emergency ejection, the wires and plumbing lines connected to the exterior utility panel and ventilation fittings would be severed by the force of the ejection, utilizing quick disconnect fittings, for example.

Figure 4:
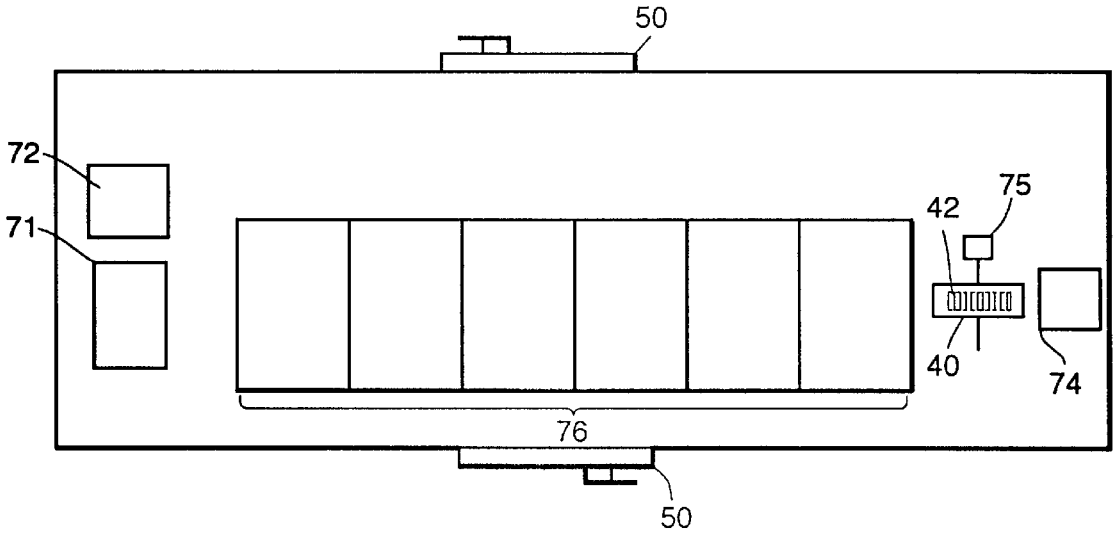
FIG. 4 is a plan view of an enclosure per the present invention (top removed for clarity), illustrating several of its interior features.

A plan view of the interior of a typical modular enclosure per the present invention (with the enclosure top removed) is shown in FIG. 4. The various elements inside the enclosure are indicated by symbolic blocks, rather than their true shapes, because they can all be conventional. The enclosure can include radio and emergency position radio beacon (EPRB) equipment 71. Oxygen scrubbers 72 can also be located inside the enclosure to provide a life sustaining atmosphere when the enclosure is sealed off. A power source 74 is preferably included to supply power to the ejection mechanism 40. For example, sprocket wheel 42 can be driven by an electric motor 75, with an uninterruptible power supply serving as power source 74, or by a hydraulic ram.

The interior of the enclosure also includes equipment 76 necessary for the operation of the ship, such as fire control, sonar, and command and decision equipment. Because the enclosures are installed within frames that are shock-mounted to the ship, the need to shock-mount individual pieces of equipment and equipment consoles is greatly reduced or eliminated. This enables a greater percentage of COTS equipment to be utilized aboard ship than is possible with existing hard-mounted equipment. COTS equipment is typically much cheaper and more readily available than equivalent ruggedized military equipment, lowering the overall cost of a ship and making reconfiguration of the ship's equipment easier.

A modularized enclosure is preferably assembled and fully tested off-ship. The enclosure is then shipped via truck or train to the shipyard and simply installed in a frame which has been secured to the ship. This approach greatly reduces the assembly and testing time currently required to install equipment aboard a ship at the shipyard, which has previously required the equipment to be set up and tested onshore, broken down and transported to the ship, installed and set up aboard ship, and then completely retested.

Maintenance is similarly simplified with the modular enclosure system presented. Rather than having to cut through the walls of the ship to access and remove hard-mounted equipment, a modular enclosure is simply removed/ejected from its frame. A new enclosure can then be installed in place of the old one, or the removed enclosure can be taken to a controlled environment for retrofitting, reconfiguring, or repair, be fully tested, and then reinstalled. By utilizing completed and tested enclosures instead of hard-mounted equipment, defects detected at the shipyard are reduced, saving both time and expense. Further savings may be realized by manufacturing a number of identical enclosures in assembly-line fashion for installation on a number of different ships.

The size of a modular enclosure per the present invention depends upon the application for which it is designed. An enclosure should not exceed the maximum size limitations of the truck or train that will be used to transport it to the shipyard. A typical enclosure for use aboard a military vessel is about 2.44 meters (8 feet) tall, about 3 meters (10 feet) wide, and about 12.2 meters (40 feet) long.

As shown in the plan view of FIG. 5, a superstructure 80 is formed by placing a number of modular enclosures side by side on the deck of a ship. Two exoskeletal frames 82 and 84 are shown secured to the ship's deck 86, as well as to other vertical and horizontal support structures 88, using shock-absorbing devices 90 at each frame-ship junction. Two modular enclosures 92 and 94 are installed in respective frames 82 and 84. Securing mechanisms on each enclosure comprise extendible pins 96, which when extended, prevent significant movement of an enclosure that is installed within its frame.

Ventilation ducting 98 connects to ventilation fittings 100 on the tops of the enclosures; the ducting may run to additional enclosures and is supplied by ventilation equipment (not shown). Wiring and/or plumbing lines 102 connect to the exterior connections of the enclosures' respective utility panels 104. Rubberized boots 106 preferably surround each utility panel, with the wiring/plumbing lines 102 running between the enclosure tops and the bottom of the boots. The boots 106 preferably extend up against a perpendicular support surface (not shown) attached to the ship. The boots around any redundant utility panels located on the bottoms of the enclosures (none are shown) extend and seal against the deck 86.

Boots 108 around respective main hatches 110 extend and seal against either a support surface 88, or to another boot extending from an adjacent enclosure. When a main hatch's boot is sealed against a support surface 88, the support surface must include either an opening or a hatchway 112 to provide access to the main hatch.

The frames 82 and enclosures 92, when mounted to the deck of a ship, form a versatile, easily maintained and reconfigurable superstructure 80. The enclosures are typically oriented with their two opposing short ends running fore and aft, and their two opposing long sides abeam ship. By adding armor-plated support surfaces 88 along the port and starboard ends of the enclosures, a double-walled superstructure is provided for added protection against shrapnel and munitions. Some or all of support surfaces 88 may comprise protective panels positioned over the port and starboard sides of the enclosures, bolted onto structures attached to the ship. Access to the enclosures for ejection is provided by unbolting the appropriate panels. Automatic removal of such panels may be incorporated as a function of the ejection mechanism.

While particular embodiments of the invention have been shown and described, numerous variations and alternate embodiments will occur to those skilled in the art. Accordingly, it is intended that the invention be limited only in terms of the appended claims.

We claim:

1. A modular enclosure system, comprising:

an enclosure which is capable of being closed on all sides, said enclosure including at least one mounting guide member affixed to an exterior surface, an exoskeletal frame into which said enclosure is installed, said frame including at least one mounting guide member which is complementary to said at least one guide member affixed to said enclosure, said enclosure when installed into said frame guided into said frame via said complementary mounting guide members, shock-absorbing devices affixed to said exoskeletal frame suitable for flexibly mounting said frame to a fixed surface, a securing mechanism arranged to secure said enclosure to said frame when said enclosure is installed within said frame and said securing mechanism is activated, and an ejection mechanism which is operable to cause said enclosure to move out of said frame along said complementary mounting guide members independently of the movement of any other enclosures.

2. The modular enclosure system of claim 1, wherein said fixed surface is a deck of a ship.

3. A modular enclosure system, comprising:

an enclosure which is capable of being closed on all sides, said enclosure including at least one mounting guide member affixed to an exterior surface, an exoskeletal frame, said frame including at least one mounting guide member which is complementary to said at least one guide member affixed to said enclosure, shock-absorbing devices affixed to said exoskeletal frame suitable for flexibly mounting said frame to a fixed surface, a securing mechanism arranged to secure said enclosure to said frame when said enclosure is installed within said frame and said securing mechanism is activated, said securing mechanism comprising a plurality of extendible pins affixed to said enclosure which, when extended with said enclosure installed within said frame, prevent significant movement of said enclosure within said frame, and an ejection mechanism which is operable to cause said enclosure to move out of said frame along said complementary mounting guide members.

4. A modular enclosure system, comprising:

an enclosure which is capable of being closed on all sides, said enclosure including at least one mounting guide member affixed to an exterior surface, an exoskeletal frame, said frame including at least one mounting guide member which is complementary to said at least one guide member affixed to said enclosure wherein said at least one mounting guide member on said frame is toothed, shock-absorbing devices affixed to said exoskeletal frame suitable for flexibly mounting said frame to a fixed surface, a securing mechanism arranged to secure said enclosure to said frame when said enclosure is installed within said frame and said securing mechanism is activated, and an ejection mechanism which is operable to cause said enclosure to move out of said frame along said complementary mounting guide members.

5. The modular enclosure system of claim 4, wherein said ejection mechanism comprises a sprocket wheel mounted to said enclosure and engaged with said frame guide member teeth when said enclosure is installed within said frame, and a power source arranged to rotate said sprocket wheel.

6. A modular enclosure system, comprising:

an enclosure which is capable of being closed on all sides, said enclosure including at least one mounting guide member affixed to an exterior surface, an exoskeletal frame, said frame including at least one mounting guide member which is complementary to said at least one guide member affixed to said enclosure, shock-absorbing devices affixed to said exoskeletal frame suitable for flexibly mounting said frame to a fixed surface, a securing mechanism arranged to secure said enclosure to said frame when said enclosure is installed within said frame and said securing mechanism is activated, and an ejection mechanism which is operable to cause said enclosure to move out of said frame along said complementary mounting guide members and said ejection mechanism deactivates said securing mechanism prior to causing said enclosure to move out of said frame.

7. A modular enclosure suitable for use aboard a ship, comprising:

an enclosure which is capable of being closed on all sides, said enclosure including a mounting guide member affixed to an exterior surface, said enclosure being a rectangular parallelepiped, the size of said enclosure limited such that it can be conveyed via truck or train.

at least one utility panel mounted through a side of said enclosure and accessible from both the interior and exterior of said enclosure, said panel providing utility services to the interior of said enclosure, at least one main hatch providing ingress to and egress from the interior of said enclosure, a securing mechanism affixed to said enclosure and operable to secure said enclosure to a support structure, and an ejection mechanism affixed to said enclosure and operable to cause said enclosure to be moved horizontally and thereby separated from a support structure to which it is secured, the ejectability and limited size of said enclosure enabling said enclosure to be easily replaced or removed and reconfigured.

8. The modular enclosure of claim 7, further comprising a respective access hatch over each utility panel.

9. The modular enclosure of claim 8, wherein said main and access hatches are water-tight, with said enclosure water-tight when said hatches are closed.

10. The modular enclosure of claim 9, wherein said enclosure floats in water when said water-tight hatches are closed.

11. The modular enclosure of claim 7, wherein each utility panel includes connections and fittings for providing electrical or plumbing services to the interior of said enclosure.

12. The modular enclosure of claim 7, wherein said enclosure includes redundant utility panels.

13. The modular enclosure of claim 7, further comprising a ventilation fitting for conveying air into the interior of said enclosure.

14. The modular enclosure of claim 7, wherein the exterior surface of said enclosure comprises a high energy impact composite material.

15. The modular enclosure of claim 7, further comprising oxygen scrubbers for maintaining a life-sustaining atmosphere inside said enclosure.

16. A modular enclosure suitable for use aboard a ship, comprising:

an enclosure which is capable of being closed on all sides, said enclosure including a mounting guide member affixed to an exterior surface, at least one utility panel mounted through a side of said enclosure and accessible from both the interior and exterior of said enclosure, said panel providing utility services to the interior of said enclosure, at least one main hatch providing ingress to and egress from the interior of said enclosure, a securing mechanism affixed to said enclosure and operable to secure said enclosure to a support structure, an ejection mechanism affixed to said enclosure and operable to cause said enclosure to be separated from a support structure to which it is secured, and an exoskeletal frame, said frame including a mounting guide member which is complementary to said enclosure's mounting guide member, said enclosure installed within said frame via said complementary guide members.

17. The modular enclosure of claim 16, wherein said securing mechanism secures said enclosure within said frame when said enclosure is installed within said frame via said complementary mounting guide members.

18. The modular enclosure of claim 16, further comprising shock-absorbing devices affixed to said exoskeletal frame suitable for flexibly mounting said frame to a fixed surface.

19. The modular enclosure of claim 18, wherein said fixed surface is a deck of a ship.

20. The modular enclosure of claim 19, wherein said enclosure contains electronic equipment and serves as a combat center aboard a military ship.

21. The modular enclosure of claim 16, wherein said at least one mounting guide member on said frame is toothed and said ejection mechanism comprises a sprocket wheel mounted to said enclosure and engaged with said frame guide member teeth when said enclosure is installed within said frame, and a power source arranged to rotate said sprocket wheel.

22. A modular enclosure suitable for use aboard a ship, comprising:

an enclosure which is capable of being closed on all sides, said enclosure including a mounting guide member affixed to an exterior surface, at least one utility panel mounted through a side of said enclosure and accessible from both the interior and exterior of said enclosure, said panel providing utility services to the interior of said enclosure, at least one main hatch providing ingress to and egress from the interior of said enclosure, a securing mechanism affixed to said enclosure and operable to secure said enclosure to a support structure, an ejection mechanism affixed to said enclosure and operable to cause said enclosure to be separated from a support structure to which it is secured, and rubberized boots around the perimeter of each main hatch and utility panel, said boots mounted on the exterior of said enclosure.

23. A ship superstructure, comprising:

a plurality of enclosures, each capable of being closed on all sides and including respective mounting guide members affixed to an exterior surface of the enclosure, at least one exoskeletal frame, each arranged to support at least one of said enclosures, each frame including, for each of the enclosures it supports, a mounting guide member which is complementary to the guide member of the supported enclosure, each of said enclosures when installed into said frame guided into said frame via said complementary mounting guide members, and respective shock-absorbing devices affixed to each exoskeletal frame suitable for flexibly mounting said frame to a deck of a ship, a plurality of ejection mechanisms affixed to the exterior surfaces of respective ones of said enclosures, said ejection mechanisms operable to cause their respective enclosures to be ejected from their respective frames independently of the movement of any other of said enclosures, said at least one frame and said enclosures forming a ship's superstructure when said frames are flexibly mounted to said deck.

24. The superstructure of claim 23, wherein said enclosures are rectangular parallelepipeds with two opposing long sides and two opposing short sides, said enclosures oriented with said opposing short sides running fore and aft, and said opposing long sides abeam ship.

25. The superstructure of claim 23, further comprising respective securing mechanisms affixed to the exterior surfaces of said enclosures, said securing mechanisms operable to secure their respective enclosures to their respective frames when said enclosures are installed within said frames.

26. A ship superstructure, comprising:

a plurality of enclosures, each capable of being closed on all sides and including respective mounting guide members affixed to an exterior surface of the enclosure, at least one exoskeletal frame, each arranged to support at least one of said enclosures, each frame including, for each of the enclosures it supports, a mounting guide member which is complementary to the guide member of the supported enclosure, respective shock-absorbing devices affixed to each exoskeletal frame suitable for flexibly mounting said frame to a deck of a ship, and a plurality of protective panels positioned over respective short enclosure sides, said at least one frame, said panels and said enclosures forming a double-walled ship's superstructure when said frames are flexibly mounted to said deck.

* * * * *